US009399280B2

(12) United States Patent
Grady

(10) Patent No.: US 9,399,280 B2
(45) Date of Patent: Jul. 26, 2016

(54) DEVICE FOR REPLACING POCKET DOOR TRACK

(71) Applicant: Patrick Grady, Concord, CA (US)

(72) Inventor: Patrick Grady, Concord, CA (US)

( * ) Notice: Subject to any disclaimer, the term of this patent is extended or adjusted under 35 U.S.C. 154(b) by 146 days.

(21) Appl. No.: 14/510,480

(22) Filed: Oct. 9, 2014

(65) Prior Publication Data

US 2016/0101507 A1 Apr. 14, 2016

(51) Int. Cl.

| | |
|---|---|
| ***B25B 21/00*** | (2006.01) |
| ***F21V 33/00*** | (2006.01) |
| ***B25G 1/10*** | (2006.01) |

(52) U.S. Cl.

CPC ..... *B25B 21/002* (2013.01); *B25G 1/105* (2013.01); *F21V 33/0084* (2013.01)

(58) Field of Classification Search

CPC ..... B25B 21/002; B25G 1/105; F21V 1/105
See application file for complete search history.

(56) References Cited

U.S. PATENT DOCUMENTS

| | | | | |
|---|---|---|---|---|
| 5,720,542 A * | 2/1998 | Birge, Jr. et al. | ..... | B25B 13/481 362/109 |
| 6,293,172 B1 * | 9/2001 | Smith | ..... | B23Q 5/043 81/177.2 |
| 6,601,478 B1 * | 8/2003 | Hanson | ..... | B25B 13/481 81/177.2 |

* cited by examiner

*Primary Examiner* — Stephen F Husar
(74) *Attorney, Agent, or Firm* — Squire Patton Boggs (US) LLP

(57) ABSTRACT

This application is directed to a device for replacing a pocket door track without removing a section of the wall adjacent the track.

20 Claims, 6 Drawing Sheets

DEVICE FOR REPLACING POCKET DOOR TRACK

FIELD OF THE INVENTION

This invention relates generally to the area of building construction, in particular to pocket doors and the replacement of the track upon which the doors are suspended and move.

BACKGROUND

A pocket door is a sliding door that that recesses into a compartment in the wall at one side of the opening into which the door is placed. Pocket doors were quite in vogue in the Victorian era but then fell out of favor because they were hard to open and close, noisy and often came off the track. In recent times, pocket doors have, however, made a come-back both as an architectural effect vehicle and as a space-saving construction in both residential and commercial settings. In addition to the advent of improved overall design and better parts both in design and construction, a primary reason for the resurgence of pocket doors is that they provide a substantial space-saving benefit, i.e., a pocket door, since it disappears completely into an adjacent wall, can increase usable floor space by 10 to 15 sq. ft. on the average.

Pocket doors are readily installed during initial construction when the space between adjacent walls is exposed. Pocket may, of course, be installed as a retrofit but this requires opening of walls, which can make the project unappealing both in terms of the construction per se and cost.

As noted above, a common problem with early pocket doors was that they had a tendency to jump the track on which they rode due to faulty construction, damage or simply wear and tear on the track. When such occurred, the very reason that made pocket doors so appealing—they could be completely hidden from sight when open and took up virtually no usable space—became their prime drawback. The only way to remedy the situation was to open the wall and replace the track. While modern track and roller design has substantially reduced the occurrence of pocket door track jumping, it does still occur and when it does it is the bane of the home or business owner faced with the time and expense of remedying the problem.

What is needed is a means of replacing pocket door tracks without the need to open the adjacent wall, which would result in a much quicker and economical replacement. This invention provides a device and method of accomplishing exactly this.

SUMMARY

Thus, in one aspect the present invention is related to a device for replacing a pocket door track, comprising:

- a rigid shaft having a proximal end, a distal end and a cross-sectional dimension that permits the shaft to be inserted into a pocket door frame;
- an electrically powered screwdriver assembly coupled to the rigid shaft at or near its distal end, wherein:
  - the electrically powered screwdriver assembly has a cross-sectional dimension that permits it to be inserted into a pocket door frame; and
  - a shaft/tip of the screwdriver assembly is capable of being positioned perpendicular to the pocket door track to be replaced; and

- a controller at or near the proximal end of the rigid shaft, which controller is operatively coupled to a power source of the screw driver assembly.

In an aspect of this invention, the rigid shaft is substantially straight and the length from its proximal end to its distal end is about 36 to about 80 inches.

In an aspect of this invention, the rigid shaft comprises 2 or more lengths that are shorter than the desired length and that are coupled together to achieve the desired length.

In an aspect of this invention, the rigid shaft is fabricated from a metal, a metal alloy, a polymer, a composite, wood or any combination of these.

In an aspect of this invention, the electrically powered screwdriver assembly comprises an electric screwdriver.

In an aspect of this invention, the electrically powered screwdriver assembly comprises a power drill having a chuck coupled to a screwdriver shaft/tip.

In an aspect of this invention, the screwdriver assembly is coupled to the rigid shaft using screws or nuts and bolts.

In an aspect of this invention, the screwdriver assembly is coupled to the rigid shaft using a clamp.

In aspect of this invention, the screwdriver assembly is coupled to the rigid shaft by a strap.

In an aspect of this invention, the strap comprises Velcro®.

In an aspect of this invention, the angle of the chuck and coupled screwdriver shaft/tip with respect to a centerline of the rigid shaft is adjustable between 0° and 90°.

In an aspect of this invention, the controller is mechanically coupled to the actuator of the power source of the screwdriver assembly.

In an aspect of this invention, the actuator of the power source of the screwdriver assembly comprises a trigger.

In an aspect of this invention, the controller is operatively coupled to the trigger by a movable cable.

In an aspect of this invention, the controller is operatively coupled directly to an electric motor of the screwdriver assembly.

In an aspect of this invention, the controller comprises a lever.

In an aspect of this invention, the controller comprises a trigger.

In an aspect of this invention, the device herein comprises one or more lights coupled to the rigid shaft at or near its distal end.

In an aspect of this invention, the screw driver assembly comprises one or more lights.

In an aspect of this invention, an electric motor of the screwdriver assembly is located at the proximal end of the rigid shaft.

BRIEF DESCRIPTION OF THE FIGURES

The figures are provided for illustrative purposes only to assist in understanding the invention herein and are not intended nor should they be construed as limiting the scope of this invention in any manner. The figures are not necessarily to scale.

It is further noted that, in some of the figures, surfaces of the various components are shown spaced apart while the description of them makes it apparent that those components are contiguous, that is, in contact with one another. It is understood that such surfaces are shown spaced apart simply for the purpose of making it easier to see and understand the relationship between them.

DETAILED DESCRIPTION

Discussion

It is understood that, with regard to this description and the appended claims, any reference to any aspect of this invention made in the singular includes the plural and vice versa unless it is expressly stated or unambiguously clear from the context that such is not intended.

As used herein, any term of approximation such as, without limitation, near, about, approximately, substantially, essentially and the like, means that the word or phrase modified by the term of approximation need not be exactly that which is written but may vary from that written description to some extent. The extent to which the description may vary will depend on how great a change can be instituted and have one of ordinary skill in the art recognize the modified version as still having the properties, characteristics and capabilities of the word or phrase unmodified by the term of approximation. In general, but with the preceding discussion in mind, a numerical value herein that is modified by a word of approximation may vary from the stated value by ±10%, unless expressly stated otherwise.

The terms "proximal" and "distal" simply refer to the opposite ends of a construct and are used as a method of orienting an object with relation to another object such as the orientation of the ends of the shaft with regard to the controller and the screwdriver assembly herein. In general, which end is designated as proximal and which as distal is purely arbitrary unless the context unambiguously expresses otherwise.

As used herein, the use of "preferred," "presently preferred," "preferably," or "more preferred," and the like refers to preferences as they exist at the time of filing of this application.

Figure 1A:
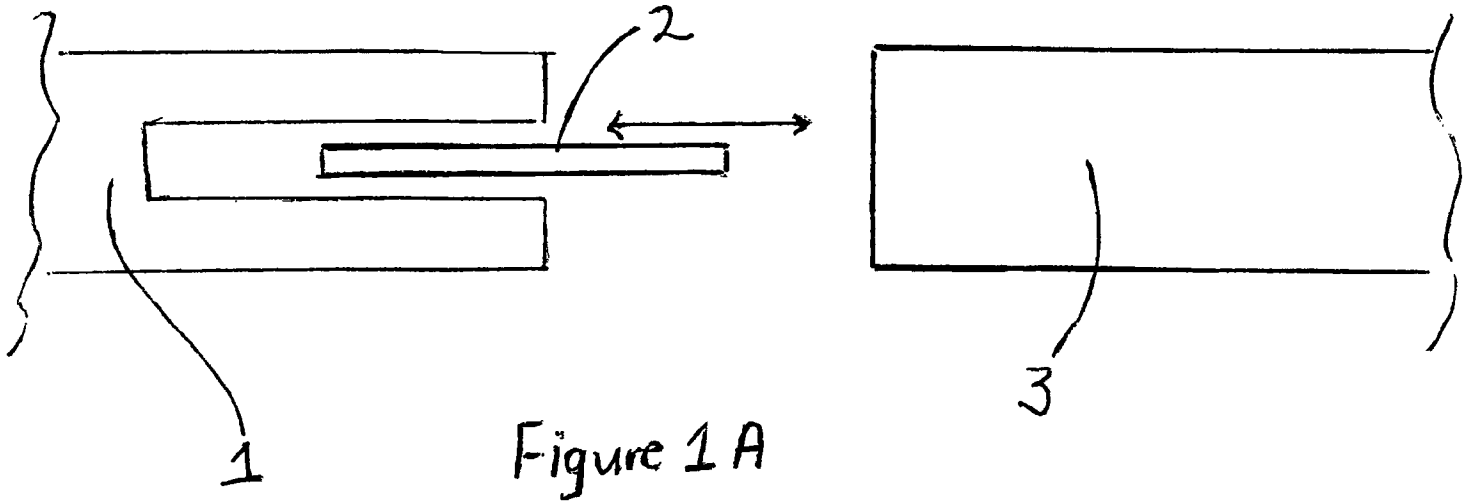
FIG. 1A is a top view illustration of a typical single door pocket door.
Figure 1B:
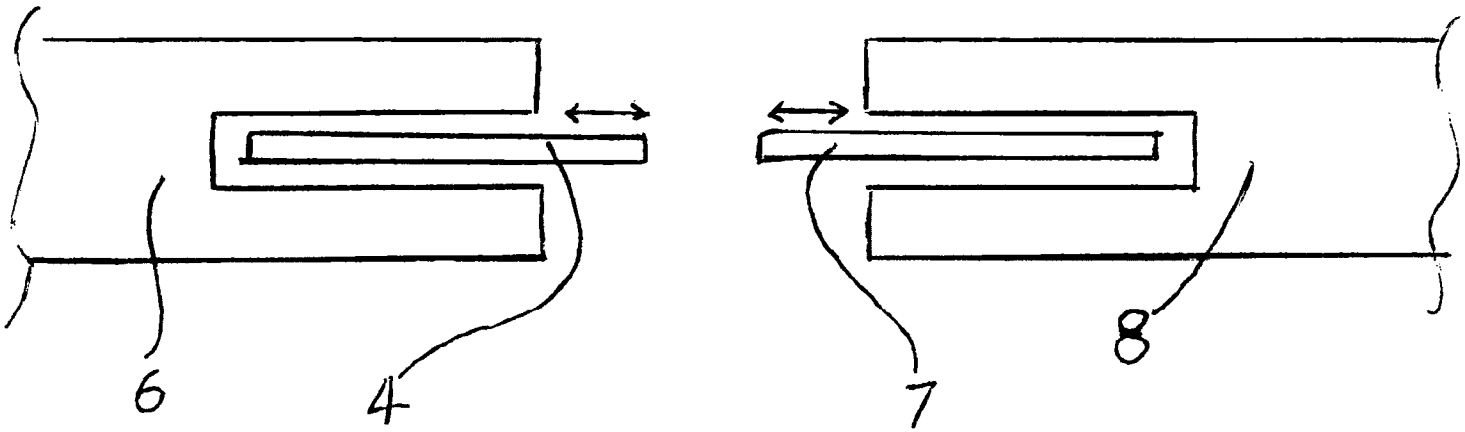
FIG. 1B is a top view illustration of a typical two door pocket door.
Figure 1D:
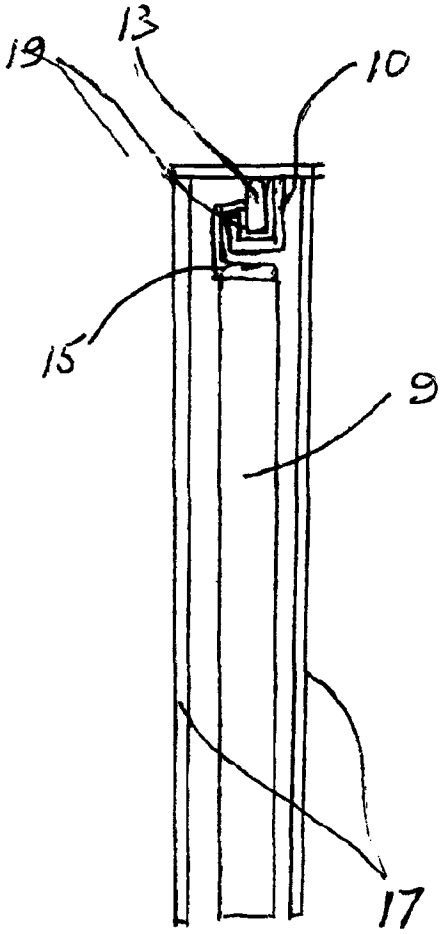
FIG. 1D is an end-on view of a typical pocket door.
Figure 1C:
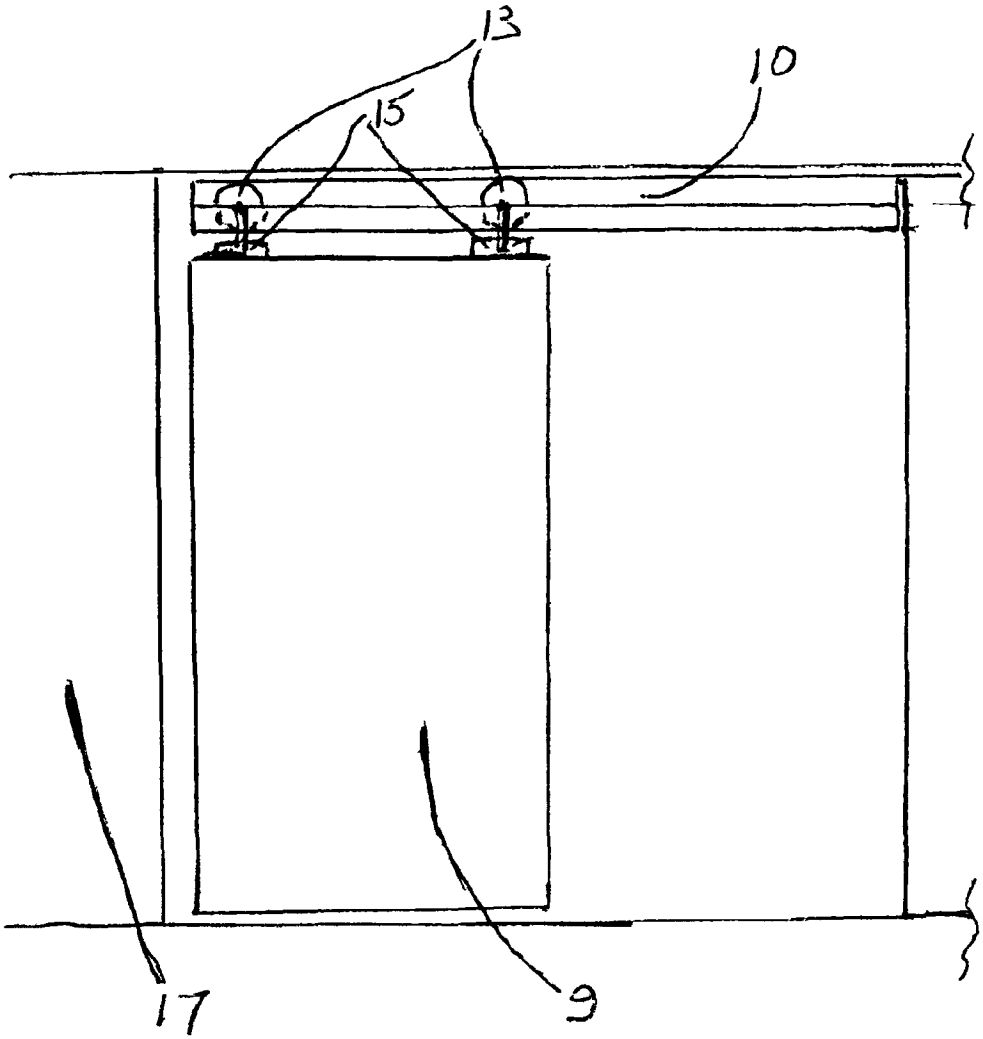
FIG. 1C is a side view of a typical pocket door.

As used herein, a "pocket door" refers to the well-known construction element that permits a sliding door or doors to recess into a space in the wall adjacent to the door. The door(s) may be interior, i.e., doors separating one room from an adjacent room or exterior, such as might be found between a family room, sitting room, etc. and an outside porch, terrace or garden. A non-limiting schematic of a single pocket door is shown in FIG. 1. FIG. 1A shows an overhead view of single pocket door 2 illustrating how it slides into wall 1 and "disappears" without using up any room space but then can be slid over until it abuts wall 3, thereby shutting off the rooms from one another. FIG. 1B shows a double pocket door comprising door 4 recessed into wall 6 and door 7 recessed into door 8. Doors 4 and door 7 can be pulled together to separate the rooms. FIG. 1C is a side view of pocket door 9 showing track 10, wheels 13 and wheel carriers 15. Track 10 is, as shown, generally installed overhead and door 9 is hung from the track by wheels 13 such that the door may be rolled easily into and out of wall 17. For the sake of illustration wall 17 is not shown concealing door 9. FIG. 1D shows and end-on view of the pocket door assembly with door 9 coupled to wheel carrier 15. Wheel 15 is shown in retaining groove 19 of track 10. The assembly in FIG. 1 is illustrated with a single wheel at each end of door 10 but it is understood that any configuration of wheels, such as, without limitation, 2 or more wheels in-line or in tandem, i.e. side-by-side wheels that ride in adjacent tracks, may constitute the traveling mechanism of the door. When any of the various types of tracks fails, the device of this invention may be used to repair or replaced the track(s) without having to break into the walls to expose the track.

In order to create a pocket door, a pocket door frame is installed in the wall into which the pocket door is to recess. The width of the opening in the pocket door frame may vary depending on the width of the wall and the width of the door to be installed but it is generally understood that the width of the opening in the pocket door frame is rarely, if ever, less than two inches. Thus, a device of this invention must have a cross-sectional dimension that is two inches or less in order to be capable of insertion into any pocket door frame.

As used herein, a "screw-driver assembly" refers to an electrical device having or capable of being fitted with a shaft that terminates in a tip, which tip is specific for use with a particular screw head drive type. Examples of screw-driving assemblies include, without limitation, a simple electrically driven screwdriver having a permanent screw head drive type, usually a slot or a Phillips head, an electrically driven screwdriver with interchangeable screw-head drive types, which may include less common screw-head drive types such as, again without limitation, Pozidriv®, square, Robertson or Allen drive types or a multi-purpose electric drill that can be fitted with a shaft comprising any sort of drive tip but that may also be fitted with a drill that can be used to drill pilot holes for screws when and if such is found necessary. The screw-driver assembly of this invention may comprise any commercial device capable of screwing screws in and out so long as the commercial device has the requisite dimensions disclosed herein to fit into a pocket door frame. Or the screw-driver assembly may be one specifically constructed for use with the device herein.

Screws may be held on the tip of the screwdriver by a number of well-known means such as the use of a magnetic shaft/tip, use of an adhesive putty, a small amount of which is placed on the tip before the tip is inserted into the screw or a sleeve that fits over the screw head holding it in place until it is inserted in the pilot hole. Based on the disclosures herein, other means of remotely holding screws on a screwdriver tip may occur to those skilled in the art; all such screw-holding techniques are within the scope of this invention.

As used herein, a "controller" refers to a device for remotely turning the electrical power of the screw-driving assembly on and off. The controller may comprise, without limitation, a lever mechanism as shown and described with regard to FIG. 2, a lever and cable mechanism as shown and described in FIG. 4 or a trigger as shown and described with regard to FIG. 5. The controller may operate simply as an on/off switch or, if the screw-driving assembly is capable of such, it may constitute a variable speed controller wherein the speed of the rotating tip is varied by the amount of pressure applied to the controller. Based on the disclosures herein, other types of controllers may occur to those skilled in the art; all such controllers are within the scope of this invention.

As used herein, an "actuator" refers to a protruding construct, which may be, without limitation, a head of a screw, a head of a bolt or a raised construct of wood, polymer, composite, metal, etc. that, when the device is in operation, applies pressure to the trigger of a screwdriver assembly to cause power to be delivered to the shaft/tip of the assembly which then rotates to drive a screw into place.

The controller may optionally be operationally coupled to a pistol grip to facilitate directing the screw-driving assembly to a location where the screw is to be inserted and to hold it there while the device is in operation.

While a currently preferred configuration of a device of this invention has the screw-driving assembly located entirely at the distal end of the device, primarily to permit the use of the device with commercial screw-driving apparatuses, it is an embodiment of this invention that the electrical power source for the screw-driving assembly be located at or near the proximal end of the device, it being coupled to the shaft/tip by means of a flexible rotating cable.

Figure 2:
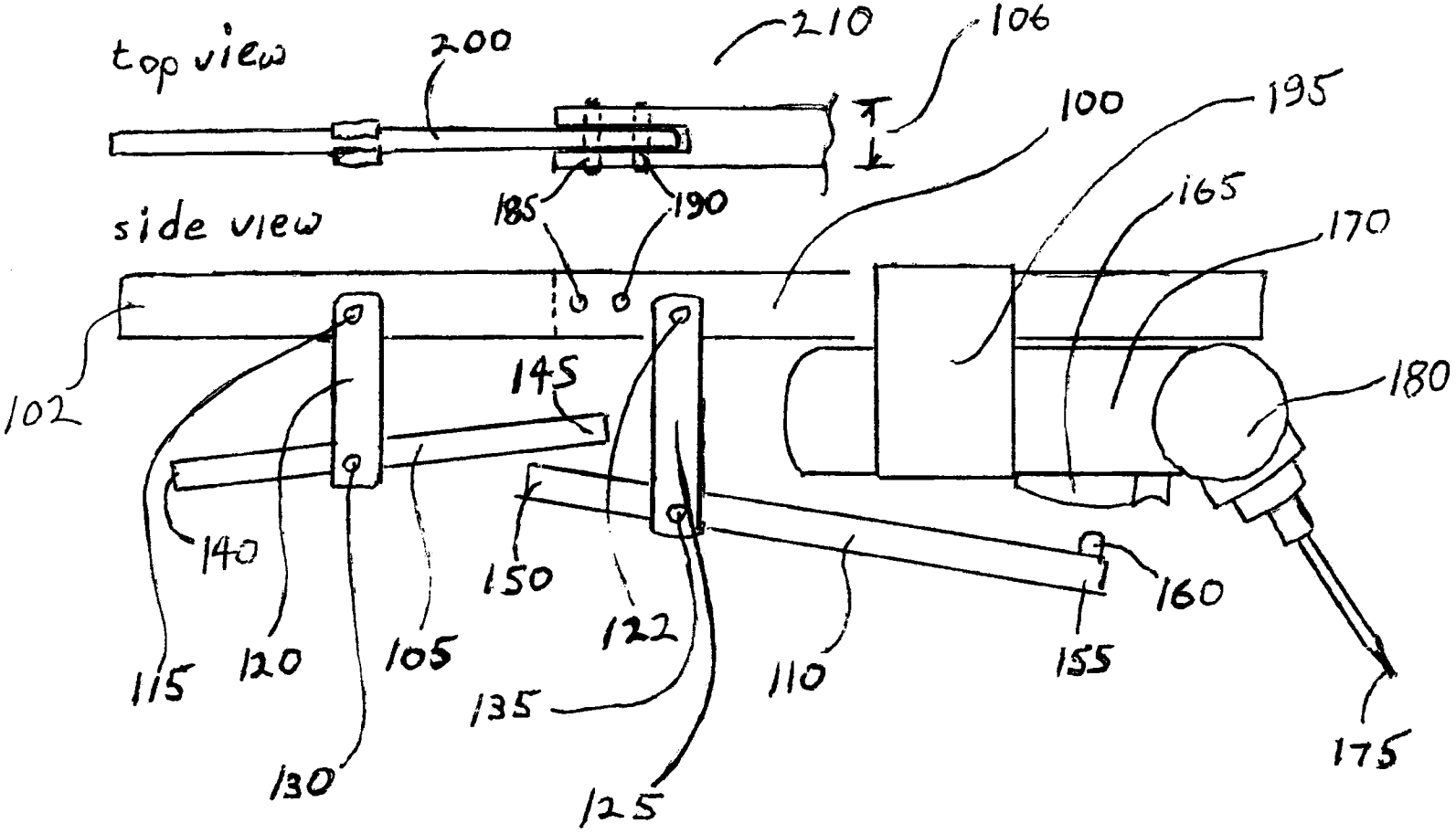
FIG. 2 is a side view and top view of an embodiment of the device of this invention.

An embodiment of the device of this invention is shown in FIG. 2. Rigid shaft 100 may be constructed of any material with the requisite strength to hold the components of the device securely in place generally and, particular, while pressure is applied to the device to hold a screw firmly in place at a pilot hole in which it is being inserted. The rigid shaft may be fabricated from materials such as wood, metal, in particular a light-weight metal such as aluminum, a polymeric material such as a rigid resin or a polymeric composite such as a carbon fiber filled polymer resin or any combination of the foregoing. Levers 105 and 110 may be made of the same or different materials that the shaft is made from. Fulcrum members 120 and 125, which likewise can be fabricated from the same material or a different material than shaft 100 and levers 105 and 110, are immovably coupled to shaft 100 by fasteners 115 and 122, which may be single fasteners as shown or may comprise two or more fasteners. Fasteners such as screws or nut and bolts assemblies are presently contemplated but other fasteners may occur to those skilled in the art and all such fasteners are within the scope of this invention. Levers 105 and 110 are moveable coupled to fulcrum members 120 and 125 by axle members 130 and 135. By "axel" is meant that levers 105 and 110 are capable of rotating on the axle in a vertical plane perpendicular to the axel. The entire assembly: 115, 120, 130, 122, 125 and 135 is reproduced (not shown in FIG. 2) on the opposite side of shaft 100 and levers 105 and 110 are placed between the two units. When upward pressure is applied to proximal end 140 of lever 105, distal end 145 of lever 105 exerts pressure on proximal end 150 of lever 110 thereby causing distal end 155 of lever 110 to move upward whereby activator button 160 exerts pressure on trigger 165 of electric motor 170 (the figure shows only the casing of the motor), thereby causing screw-driving tip 175 to rotate. In FIG. 2, the electric motor 170 and moveable chuck mechanism 180 comprise a commercial drill such as a Bosch I-drive®, but those skilled in the art will recognize other commercial drill assembles with the requisite cross-section, that is, less than two inches, that may be used with the device herein and all such commercial drills are within the scope of this invention. Electric motor 170 is shown coupled to shaft 100 by wrap 195 that encompasses electric motor 170 and shaft 110. The wrap may comprise, without limitation, adhesive tape or, preferably at present, a hook and loop fastening material such as Velcro®. If desired, shaft 110 may comprise two or more lengths of material that may be coupled together as shown by fasteners 185 and 190 as shown. The primary purpose of multi-stage shaft is ease of transport of the device, that is, the segments of shaft may be assembled on site for use. Shaft member 200 is shown coupled to shaft member 100 in overhead view 210. Other means of securing shaft member 200 to shaft 100 may, of course, be used without exceeding the scope of this invention.

As seen in the top view of FIG. 2, dimension 106 of the device is two inches or less so that the device can fit into the opening of a pocket door frame.

As shown, proximal end 102 of shaft 100, the "handle" of the device, is shown without any modification, that is, it is merely an extension of the shaft. It is understood that proximal end 102 may be modified to create a more comfortable handle by contouring shaft 100 at its proximal end or by adding material, such as, without limitation, a rubber sleeve into which proximal end 102 of shaft 100 is inserted or a tape wrap.

If desired, electric motor 170 may be coupled to shaft 100 by means other than a wrap such as by the use of fasteners such as screws or nuts and bolts wherein the electric motor outer shell is modified to comprise either a bolt that can be inserted in a through hole in shaft 100 and secured in place with a nut.

Figure 3:
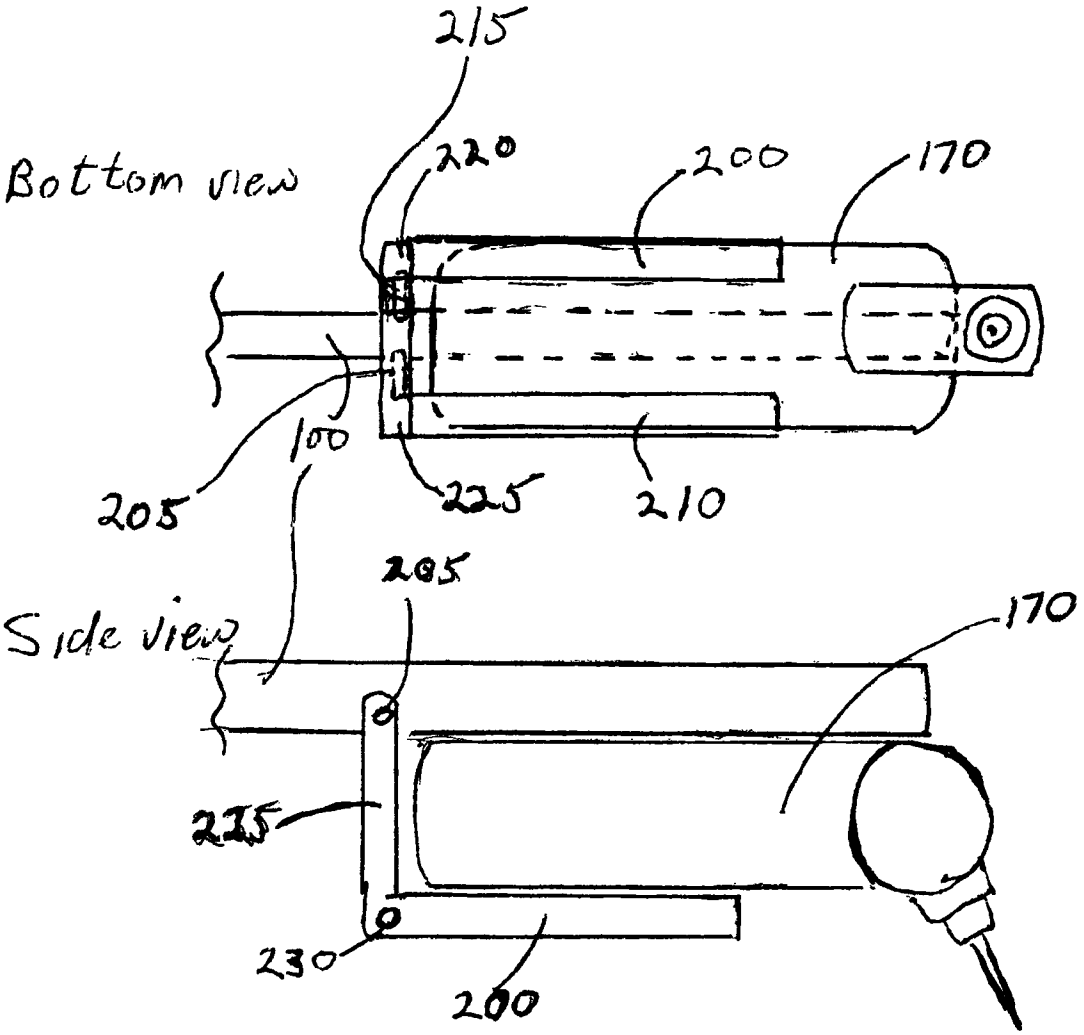
FIG. 3 is an alternative embodiment of a means for coupling and securing the screw-driving assembly electric motor to a rigid shaft.

Alternatively, electric motor 170 may be coupled to shaft 100 by a clamping mechanism whereby two parallel arms extend along the casing of the electric motor on the opposite side of the electric motor casing from shaft 100 such that the electric motor is trapped between the two arms and shaft 100. Such an arrangement is shown in FIG. 3, which is a partial view of a device herein intended only to illustrate a clamp-type coupler. Shaft 100 is on one side of electric motor 170 and arms 200 and 210 are on the other side. Arms 200 and 210 are coupled to shaft 100 through vertical arms 220 and 225, which are secured in place by fasteners 205 and 215. Only arm 210 is shown in the side view but it is understood that arm 200 is similarly fastened on the other side of the electric motor 170 casing. The fasteners may be screw-type fasteners, nut and bolt-type fasteners or any other fastener that securely holds arms 200 and 210 and thereby electric motor 170 in place.

Other means of securing the electric motor to the shaft may occur to those skilled in the art based on the disclosures herein; al such coupling mechanisms are within the scope of this invention.

If desired a combination of coupling mechanisms may be used to assure tightly securing the screw-driving assembly to the shaft.

Figure 4:
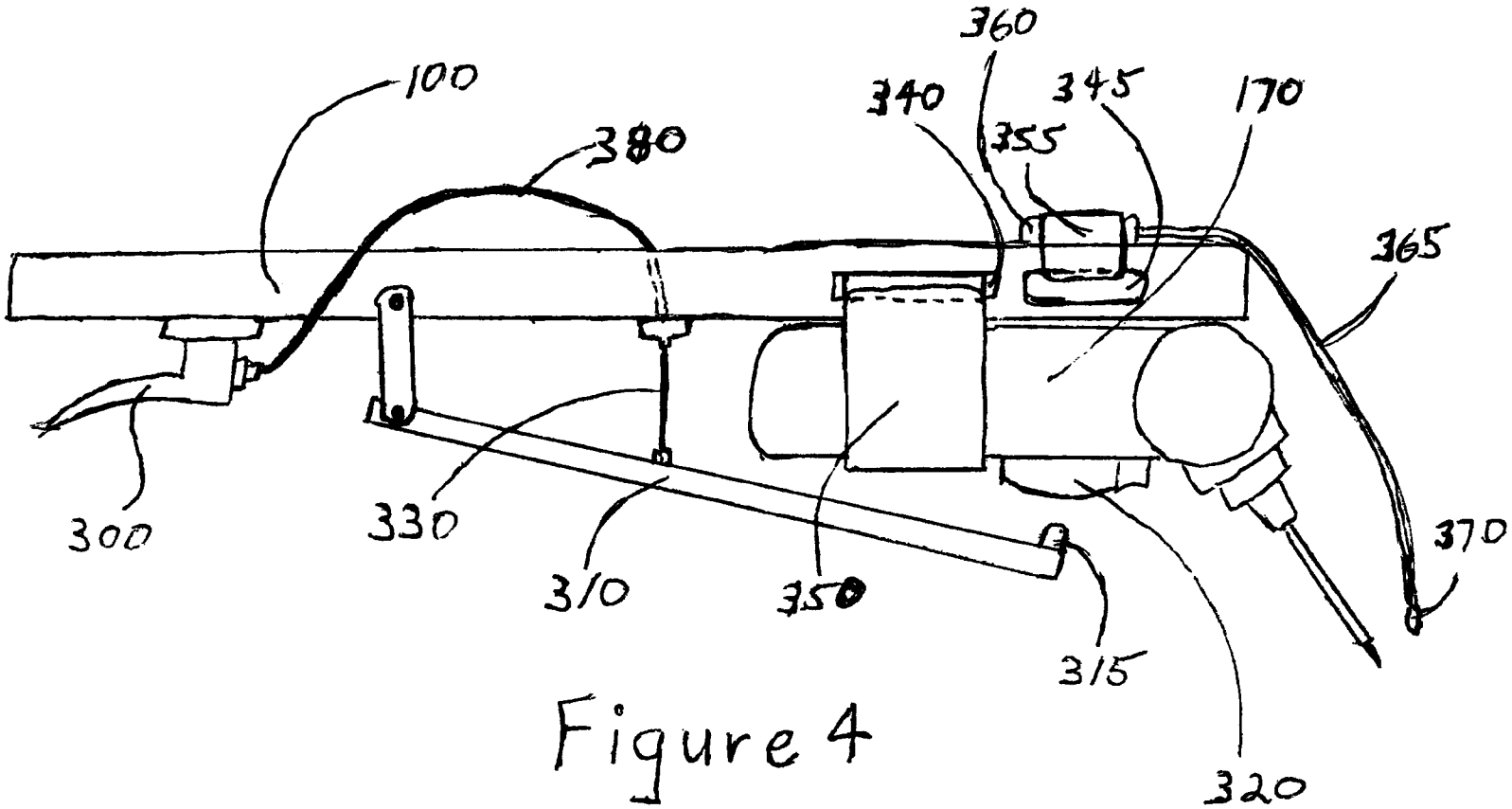
FIG. 4 is a side view of an embodiment of the device of this invention.

FIG. 4 illustrates another embodiment of this invention. In FIG. 4, a cable system is used to couple lever 300 to lever 310. When lever 300 is depressed, i.e., pulled upward toward shaft 100, wire 330 situated within cable 380 pulls up on lever 310 which causes actuator button 315 to press against trigger 320 of electric motor 170 thus turning the motor on. The lever/cable/wire system is fashioned after, and in fact may comprise, a standard bicycle brake cable assembly. FIG. 4 also shows additional features of the device of this invention, which features may be incorporated into any embodiment of the device. In FIG. 4, shaft 100 is shown with through-slots 340 and 345, which slots are used for coupling straps 350 and 355. Strap 350 is used to hold electric motor 170 in place while strap 355 is used to hold battery pack 360, which is connected by cable 365 to light source 370.

Figure 5:
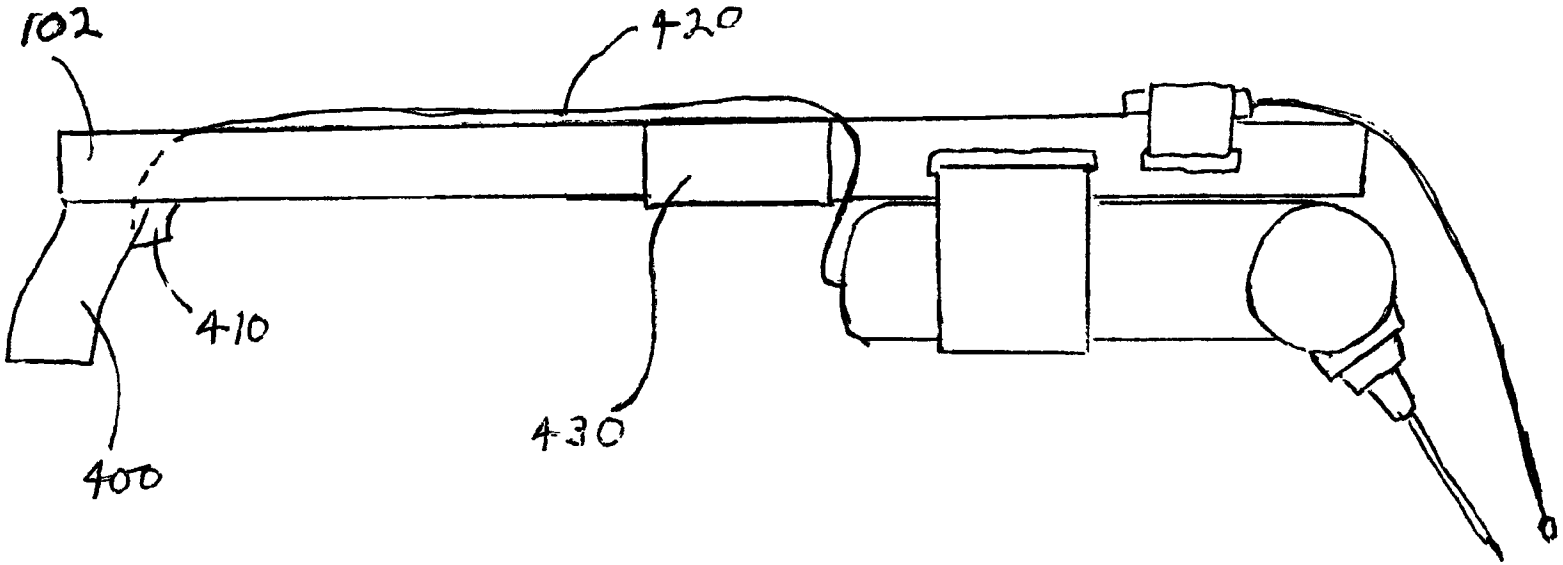
FIG. 5 is a side view of an embodiment of the device of this invention.

FIG. 5 shows another embodiment of this invention. In FIG. 5, proximal end 102 of shaft 100 is fitted with pistol grip 400, which pistol grip is coupled to trigger 410. Trigger 410 is electrically coupled by wire 420 directly to electric motor 170 such that, when trigger 410 is pulled the motor is turned on. FIG. 5 also shows an additional feature of the device of this invention, which may be incorporated into any embodiment of the invention. That is, shaft 100 is fitted with grip 430 to facilitate holding the device.

Based on the disclosures herein, those skilled in the art will perceive alternative configurations of the device of this invention, but which do not alter the prime purpose of the invention: reaching otherwise difficult, if not impossible to reach regions of a pocket door track to unscrew and remove a faulty track and to replace that track with a new track. All such alternative configurations of the device are within the scope of this invention.

What is claimed:

1. A device for replacing a pocket door track, comprising:

a rigid shaft having a proximal end, a distal end and a cross-sectional dimension that permits the shaft to be inserted into a pocket door frame;

an electrically powered screwdriver assembly coupled to the rigid shaft at or near its distal end, wherein:

the electrically powered screwdriver assembly has a cross-sectional dimension that permits it to be inserted into a pocket door frame; and a shaft/tip of the screwdriver assembly is capable of being positioned perpendicular to the pocket door track to be replaced; and a controller at or near the proximal end of the rigid shaft, which controller is operatively coupled to a power source of the screw driver assembly.

2. The device of claim 1, wherein the rigid shaft is substantially straight and the length from its proximal end to its distal end is about 36 to about 80 inches.

3. The device of claim 2, wherein the rigid shaft comprises 2 or more lengths that are shorter than the desired length and that are coupled together to achieve the desired length.

4. The device of claim 1, wherein the rigid shaft is fabricated from a metal, a metal alloy, a polymer, a composite, wood or any combination of these.

5. The device of claim 1, wherein the electrically powered screwdriver assembly comprises an electric screwdriver.

6. The device of claim 1, wherein the electrically powered screwdriver assembly comprises a power drill having a chuck coupled to a screwdriver shaft/tip.

7. The device of claim 1, wherein the screwdriver assembly is coupled to the rigid shaft using screws or nuts and bolts.

8. The device of claim 1, wherein the screwdriver assembly is coupled to the rigid shaft using a clamp.

9. The device of claim 1, wherein the screwdriver assembly is coupled to the rigid shaft by a strap.

10. The device of claim 9, wherein, the strap comprises Velcro®.

11. The device of claim 6, wherein the angle of the chuck and coupled screwdriver shaft/tip with respect to a centerline of the rigid shaft is adjustable between 0° and 90°.

12. The device of claim 1, wherein the controller is mechanically coupled to the actuator of the power source of the screwdriver assembly.

13. The device of claim 1, wherein, the actuator of the power source of the screwdriver assembly comprises a trigger.

14. The device of claim 1, wherein the controller is operatively coupled to the trigger by a movable cable.

15. The device of claim 1, wherein the controller is operatively coupled directly to an electric motor of the screwdriver assembly.

16. The device of claim 1, wherein the controller comprises a lever.

17. The device of claim 1, wherein the controller comprises a trigger.

18. The device of claim 1, further comprising one or more lights coupled to the rigid shaft at or near its distal end.

19. The device of claim 1, wherein the screw driver assembly comprises one or more lights.

20. The device of claim 1, wherein an electric motor of the screwdriver assembly is located at the proximal end of the rigid shaft.

* * * * *